US008127370B2

(12) United States Patent
Nunn

(10) Patent No.: US 8,127,370 B2
(45) Date of Patent: Mar. 6, 2012

(54) BREAKAWAY SPORT PANTS AND METHOD OF USE

(76) Inventor: Daron D. Nunn, Bakersfield, CA (US)

( * ) Notice: Subject to any disclaimer, the term of this patent is extended or adjusted under 35 U.S.C. 154(b) by 1109 days.

(21) Appl. No.: 11/650,365

(22) Filed: Jan. 8, 2007

(65) Prior Publication Data

US 2007/0204376 A1 Sep. 6, 2007

Related U.S. Application Data

(63) Continuation-in-part of application No. 11/269,107, filed on Nov. 8, 2005, now abandoned.

(51) Int. Cl.
*A41D 13/00* (2006.01)

(52) U.S. Cl. ..... 2/69; 2/227; 24/387

(58) Field of Classification Search ..... 2/69, 115, 2/119, 1; 24/387, 390, 415
See application file for complete search history.

(56) References Cited

U.S. PATENT DOCUMENTS 2,154,099 A * 4/1939 Marinsky ..... 24/388
2,632,933 A * 3/1953 Firing ..... 24/436
2,923,009 A * 2/1960 Cookman ..... 2/227
3,530,549 A * 9/1970 Manchester, Jr. ..... 24/404
3,711,865 A * 1/1973 Schifman ..... 2/79
3,800,330 A * 4/1974 Bowcut ..... 2/227
5,706,523 A * 1/1998 Witzel ..... 2/238
5,745,960 A * 5/1998 Dishner et al. ..... 24/381
5,918,310 A * 7/1999 Farahany ..... 2/23
2002/0129470 A1* 9/2002 Kiely ..... 24/433
2004/0117954 A1* 6/2004 Lin ..... 24/429

* cited by examiner

*Primary Examiner* — Khoa Huynh
*Assistant Examiner* — Richale Quinn
(74) *Attorney, Agent, or Firm* — Timothy Thut Tyson; Ted Masters; Freilich, Hornbaker & Rosen

(57) ABSTRACT

Breakaway sport pants include right and left side zippers that do not have catch mechanisms. When the zippers are zipped, right and left connectors hold the front and back portions of the sport pants together and prevent the zippers from unzipping. However, when the right and left connectors are disengaged, the zippers easily unzip to allow removal of the sport pants. In an embodiment of the invention, the zipper pull tabs include a friction enhancing material that catches on the connectors and upper portions of the pants to prevent inadvertent unzipping of the pants.

4 Claims, 4 Drawing Sheets

Fig. 7
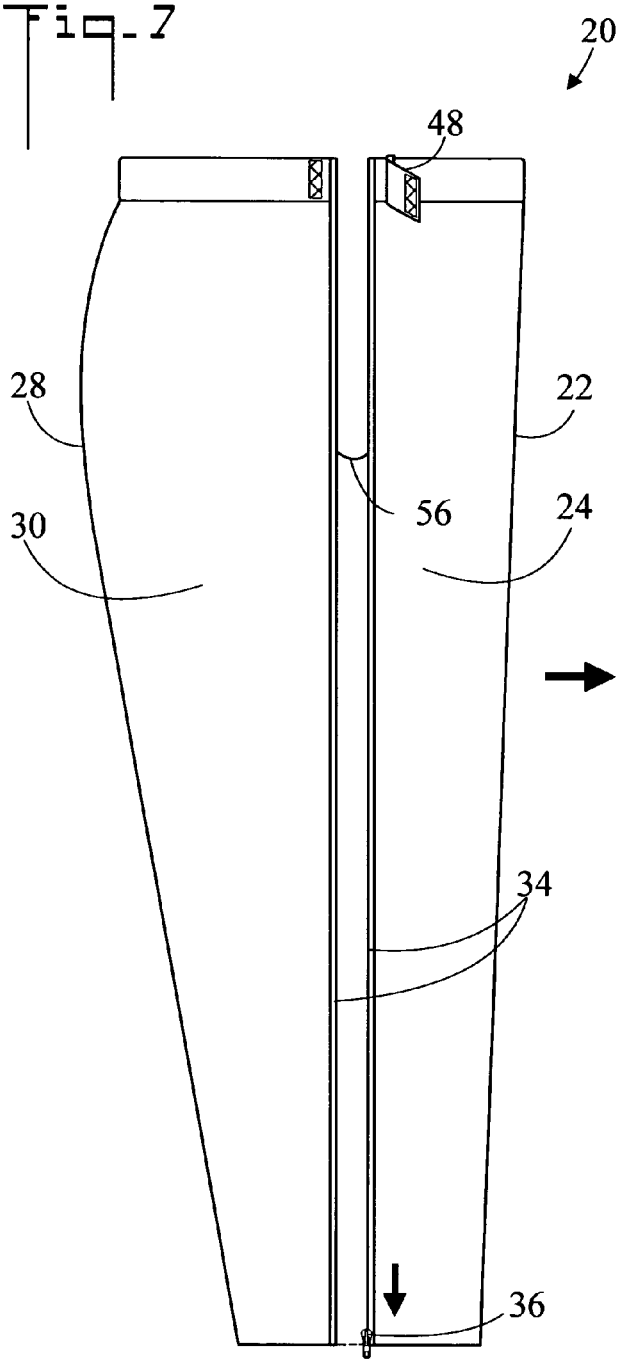
Fig. 8
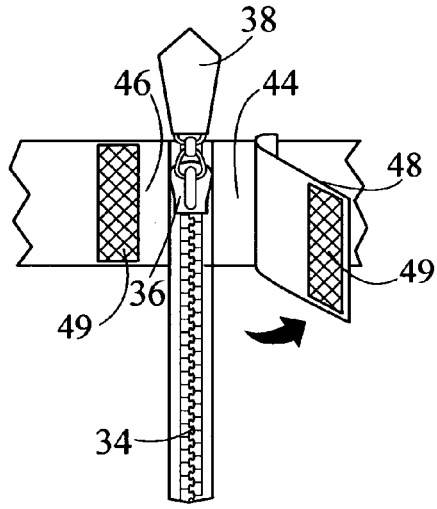
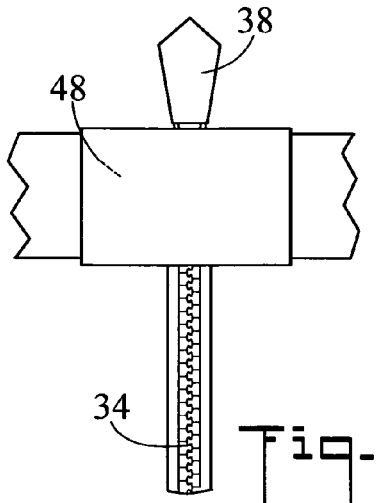
Fig. 9

BREAKAWAY SPORT PANTS AND METHOD OF USE

CROSS REFERENCE TO RELATED APPLICATION

This application is a Continuation-In-Part and claims the filing benefit under 35 U.S.C. §120 of application Ser. No. 11/269,107, filed Nov. 8, 2005 now abandoned, which is included herein by reference.

TECHNICAL FIELD

The present invention pertains generally to pants, and more particularly to breakaway sport pants which may be rapidly removed by unzipping catchless zippers.

BACKGROUND OF THE INVENTION

Breakaway (tear away, or strip off) sport pants are well known in the art. When athletes are sitting on the bench or otherwise temporarily not engaged in their physical activities, they need to keep their legs warm in order to avoid stresses and strains when they do resume athletic action. A problem exists however in that regular sport pants cannot be conveniently removed when the athlete is wearing large shoes, skates, or other large footwear. In such instances, the athlete would have to take off his shoes, remove his pants, and then put his shoes back on. Such a lengthy process would be unacceptable in rapid paced sports environments. To overcome this situation, athletes use breakaway pants which come completely apart at the sides from waist to ankle.

The traditional breakaway sport pants can be made with seven or eight buttons on the outer sides of the legs. These buttons go into large button holes that just barely hold the buttons to keep the legs together. When the player needs to go onto the field or court, he or she strips away the front half of the pants off of the buttons dropping the bottom half on the bench and floor. One problem with these button pants is that the buttons are often torn off in the process of tearing off the pants. Another version of breakaway sport pants utilizes conventional side zippers instead of buttons.

BRIEF SUMMARY OF THE INVENTION

The present invention is directed to breakaway sport pants that are worn by athletes. The breakaway sport pants have right and left zippers that extend the entire length of the pants from the waist to the ankle. In contrast to conventional zippers, the zippers of the present invention do not have catch mechanisms for holding the zipper slides in the zipped position. As such, the zippers of the present invention will easily unzip. Right and left connectors hold the front and back portions of the sport pants together when the sport pants are being worn by a wearer, and prevent the zippers from unzipping. However, when the connectors are disengaged, the zippers easily unzip so the sport pants may be quickly removed.

In accordance with a preferred embodiment of the invention, breakaway sport pants include a front portion having a right side and an opposite left side, and a back portion having a right side and an opposite left side. A right zipper selectively connects the right side of the front portion to the right side of the back portion, the right zipper not having a catch mechanism. A left zipper selectively connects the left side of the front portion to the left side of the back portion, the left zipper not having a catch mechanism.

In accordance with an aspect of the invention, the right side of the front portion has a top area, and the right side of the back portion has a top area. A right connector selectively connects the top area of the right side of the front portion and the top area of the right side of the back portion. The left side of the front portion has a top area, and the left side of the back portion has a top area. A left connector selectively connects the top area of the left side of the front portion and the top area of the left side of the back portion.

In accordance with another aspect of the invention, the right connector includes a right flap that is permanently attached to one of the top area of the right side of the front portion and the top area of the right side of the back portion. The right flap is selectively connectable by connection means to the other of the top area of the right side of the front portion and the top area of the right side of the back portion. And, the left connector includes a left flap that is permanently attached to one of the top area of the left side of the front portion and the top area of the left side of the back portion. The left flap is selectively connectable by connection means to the other of the top area of the left side of the front portion and the top area of the left side of the back portion.

In accordance with another aspect of the invention, the right zipper has a right zipper pull tab, and the left zipper has a left zipper pull tab. Each of the pull tabs includes a friction enhancing material.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 7 is a right side elevation view showing the front portion of the breakaway sport pants separated from the back portion;

FIG. 8 is an enlarged view as in FIG. 4 showing a second embodiment of a zipper pull tab; and, FIG. 9 is an enlarged view as in FIG. 3 showing the zipper pull tab with the right flap connected.

DETAILED DESCRIPTION OF THE INVENTION

Figure 1:
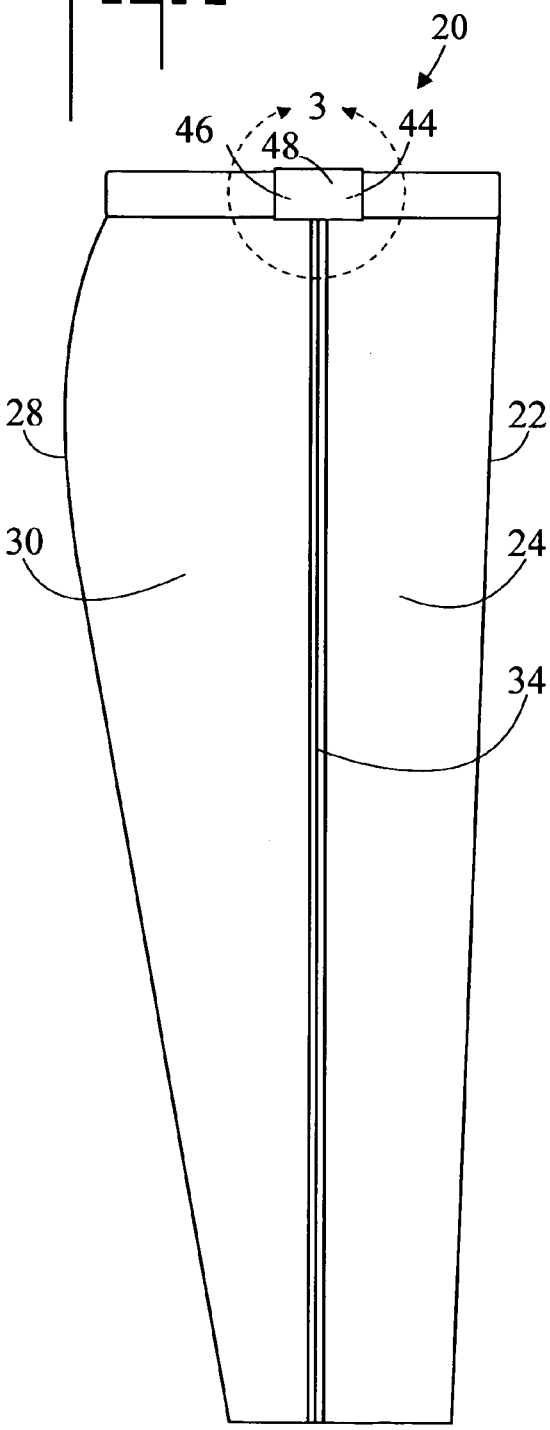
FIG. 1 is a right side elevation view of breakaway sport pants in accordance with the present invention.
Figure 2:
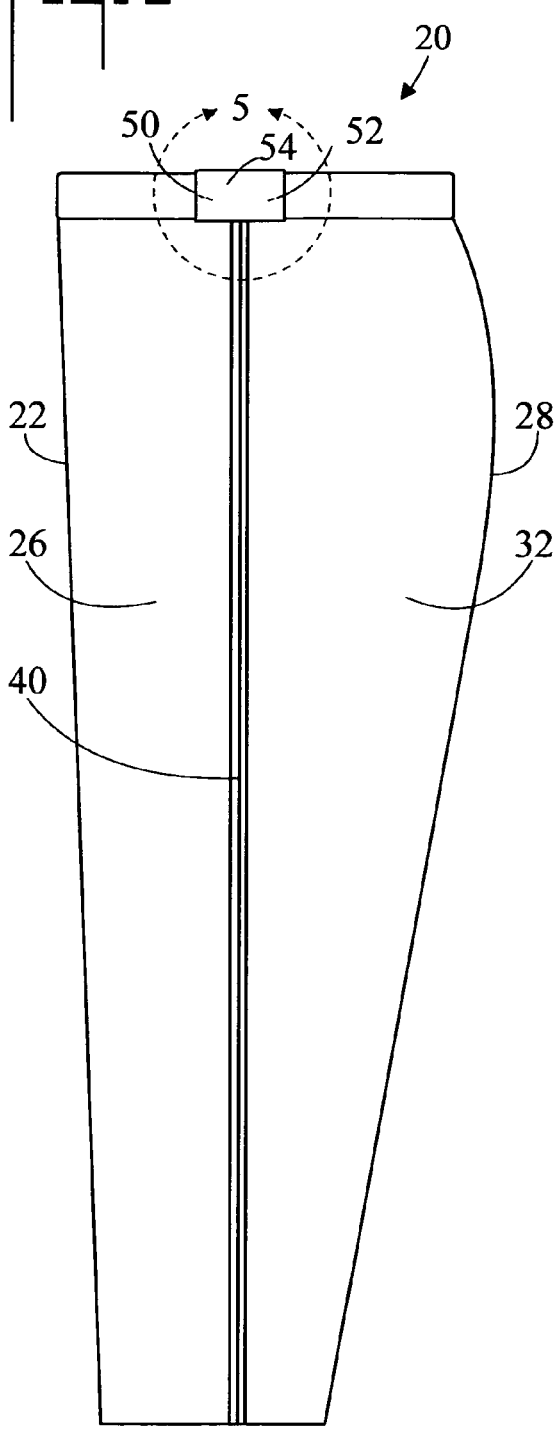
FIG. 2 is a left side elevation view.
Figure 3:
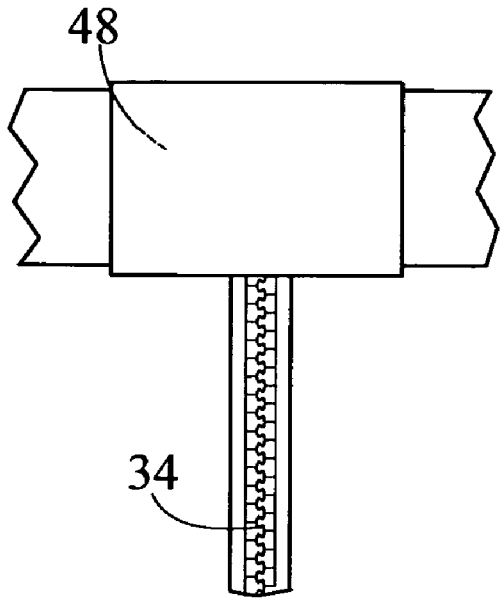
FIG. 3 is an enlarged view of area 3 of FIG. 1.
Figure 4:
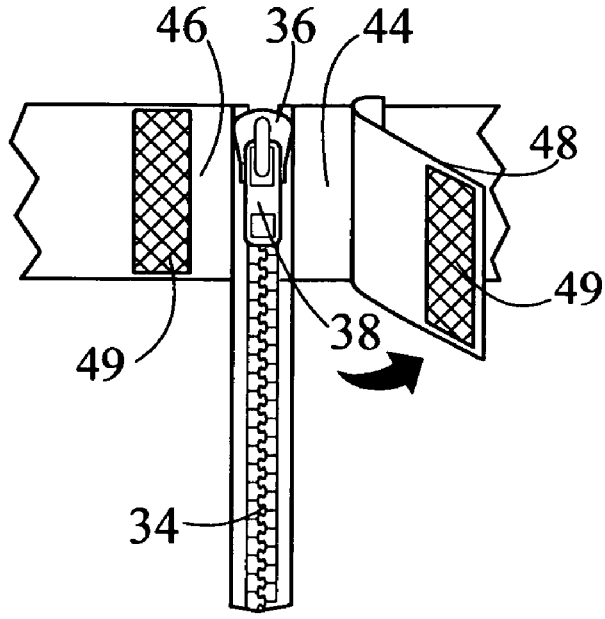
FIG. 4 is a view of FIG. 3 with a right connector disengaged.
Figure 5:
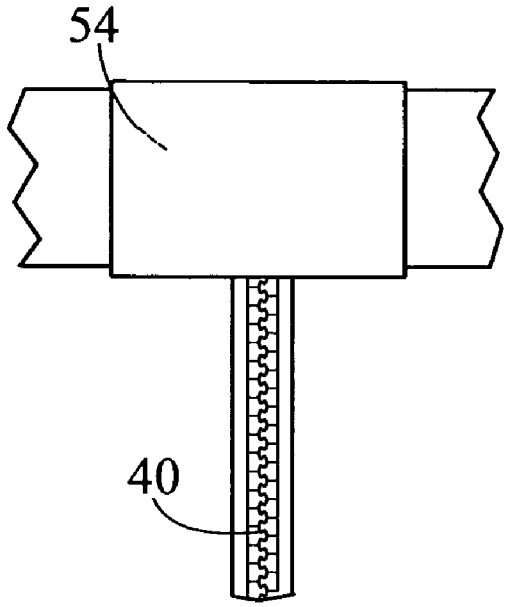
FIG. 5 is an enlarged view of area 5 of FIG. 2.

Referring initially to FIGS. 1 and 2, there are illustrated right side and left side elevation views, respectively, of breakaway sport pants in accordance with the present invention, generally designated as 20. FIG. 3 is an enlarged view of area 3 of FIG. 1. FIG. 4 is a view of FIG. 3 with a right connector disengaged. FIG. 5 is an enlarged view of area 5 of FIG. 2. And FIG. 6 is a view of FIG. 5 with a left connector disengaged.

Breakaway sports pants 20 include a front portion 22 having a right side 24 and an opposite left side 26, and a back portion 28 having a right side 30 and an opposite left side 32. A right zipper 34 selectively connects right side 24 of front portion 22 to right side 30 of back portion 28. Right zipper 34 has a right zipper slide 36 and a right zipper pull tab 38, but does not have a catch mechanism. Similarly, a left zipper 40 selectively connects left side 26 of front portion 22 to left side 32 of back portion 28. Left zipper 40 has a left zipper slide 42 and a left zipper pull tab 45, but does not have a catch mechanism. A catch mechanism, which is standard on all conventional zippers, is any device that prevents the zipper slide from unzipping the zipper unless the zipper pull tab is pulled. One such type of catch mechanism includes a spring loaded stop installed in the zipper slide. Because of the catch mechanisms, conventional zippers stay zipped and do not inadvertently unzip. Conversely, the zippers of the present invention purposefully do not include catch mechanisms so they will easily and quickly come unzipped (also refer to FIG. 7 and the discussion pertaining thereto).

Referring to FIGS. 1, 3, and 4, right side 24 of front portion 22 has a top area 44. Right side 30 of back portion 28 has a top area 46 that is adjacent top area 44 of front portion 22. A right connector selectively connects top area 44 of right side 24 of front portion 22 and top area 46 of right side 30 of back portion 28. In the shown embodiment, the right connector includes a right flap 48 that is permanently attached to one of top area 44 of right side 24 of front portion 22 and top area 46 of right side 30 of back portion 28. Right flap 48 is selectively connectable by connection means to the other of top area 44 of right side 24 of front portion 22 and top area 46 of right side 30 of back portion 28. In the shown embodiment, right flap 48 is permanently attached to top area 44 of right side 24 of front portion 22. Also in the shown embodiment, the connection means includes hook and loop fasteners 49. However, other connection devices such as a button, a snap, a hook, and the like could also be employed to effect the connection.

Figure 6:
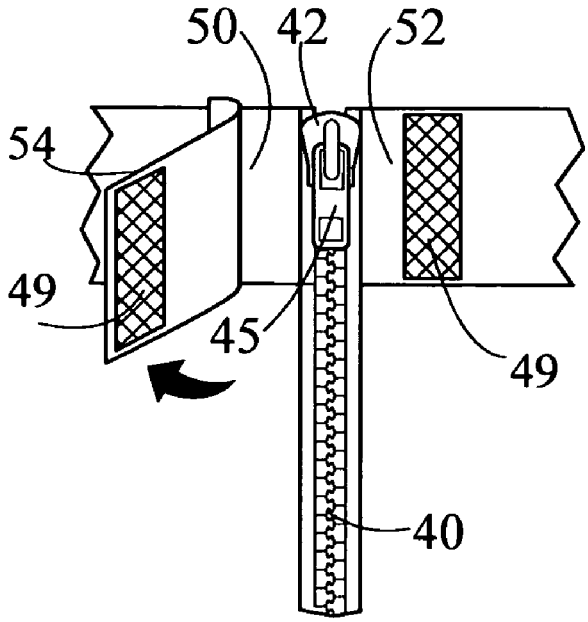
FIG. 6 is a view of FIG. 5 with a left connector disengaged.

Referring to FIGS. 2, 5, and 6, left side 26 of front portion 22 has a top area 50, and left side 32 of back portion 28 has a top area 52 that is adjacent top area 50 of front portion 22. A left connector selectively connects top area 50 of left side 26 of front portion 22 and top area 52 of left side 32 of back portion 28. In the shown embodiment, the left connector includes a left flap 54 that is permanently attached to one of top area 50 of left side 26 of front portion 22 and top area 52 of left side 32 of back portion 28. Left flap 54 is selectively connectable by connection means to the other of top area 50 of left side 26 of front portion 22 and top area 52 of left side 32 of back portion 28. In the shown embodiment, left flap 54 is permanently attached to top area 50 of left side 26 of front portion 22. Also in the shown embodiment, the connection means includes hook and loop fasteners 49. However, other connection devices such as a button, a snap, a hook, and the like could also be employed to effect the connection.

When engaged, the right and left connectors (flaps 48 and 54 in the shown embodiment) hold front portion 22 and back portion 28 together and thereby prevent catchless right zipper 34 and catchless left zipper 40 from inadvertently opening (refer to FIGS. 1, 2, 3, and 5).

FIG. 7 is a right side elevation view showing front portion 22 of the breakaway sport pants 20 separated from back portion 28. An opposite left side view would show a mirror image arrangement with appropriate left side reference numerals (refer to FIGS. 2, 5, and 6). The wearer of breakaway sport pants 20 disengages right connector (right flap 48) and left connector (left flap 54). The wearer then unzips right zipper 34 and left zipper 40 and removes breakaway sport pants 20. Since right zipper 34 and left zipper 40 do not have catch mechanisms, they will readily unzip when front portion 22 and back portion 28 are pulled apart. It is noted that while the front 22 and back 28 portions of breakaway sport pants 20 are no longer connected at the sides, they are still connected at the crotch 56 in the conventional manner. The dashed line at the bottom (ankle) of sport pants 20 represents the inside portion of the right leg of the pants.

FIG. 8 is an enlarged view as in FIG. 4 showing a second embodiment of a right zipper pull tab 38. FIG. 9 is an enlarged view as in FIG. 3 showing right zipper pull tab 38 with right connector (right flap 48) connected. In this embodiment right zipper pull tab 38 includes a friction enhancing material. As such, when right flap 48 is connected as in FIG. 9, the friction enhancing material will prevent right zipper pull tab 38 from going down past right flap 48 and thereby prevent zipper 34 from inadvertently unzipping. This tendency to keep zipper 34 zipped is enhanced by placing right zipper pull tab 38 in the shown upstanding position so the bottom of the pull tab will abut the upper edge of the right flap 48 as shown in FIG. 9 and the upper edges of top areas 44 and 46 as shown in FIG. 8 before it can even start to slide down between the flap and top areas. In an embodiment of the invention, the friction enhancing material is silicon rubber which is molded around zipper pull tab 38. It may be appreciated that left zipper pull tab 45 may be similarly constructed.

Referring to FIGS. 1-7 and the discussions pertaining thereto, in terms of use, a method for a wearer to quickly remove breakaway sport pants 20 includes:

(a) providing breakaway sport pants 20 worn by the wearer, the breakaway sport pants 20 including:

a front portion 22 having a right side 24 and an opposite left side 26;

a back portion 28 having a right side 30 and an opposite left side 32;

a right zipper 34 selectively connecting right side 24 of front portion 22 to right side 30 of back portion 28, right zipper 34 not having a catch mechanism;

right side 24 of front portion 22 having a top area 44, and right side 30 of back portion 28 having a top area 46;

a right connector for selectively connecting top area 44 of right side 24 of front portion 22 to top area 46 of right side 30 of back portion 28;

a left zipper 40 selectively connecting left side 26 of front portion 22 to left side 32 of back portion 28, left zipper 40 not having a catch mechanism;

left side 26 of front portion 22 having a top area 50, and left side 32 of back portion 28 having a top area 52; and, a left connector for selectively connecting top area 50 of left side 26 of front portion 22 to top area 52 of left side 32 of back portion 28;

(b) the wearer disengaging the right and left connectors; and, (c) the wearer unzipping right 34 and left 40 zippers and removing breakaway sport pants 20.

The method further including:

in step (a), the right connector including a right flap 48 that is permanently attached to one of top area 44 of right side 24 of front portion 22 and top area 46 of right side 30 of back portion 28, right flap 48 being selectively connectable by connection means to the other of top area 44 of right side 24 of front portion 22 and top area 46 of right side 30 of back portion 28;

in step (a), the left connector including a left flap 54 that is permanently attached to one of top area 50 of left side 26 of front portion 22 and top area 52 of left side 32 of back portion 28, left flap 54 being selectively connectable by connection means to the other of top area 50 of left side 26 of front portion 22 and top area 52 of left side 32 of back portion 28;

in step (b), the disengaging being effected by disengaging the connection means.

Also referring to FIGS. 8 and 9, a method for a wearer to put on breakaway sport pants includes:

(a) providing breakaway sport pants, including:

a front portion 22 having a right side 24 and an opposite left side 26;

a back portion 28 having a right side 30 and an opposite left side 32;

a right zipper 34 selectively connecting right side 24 of front portion 22 to right side 30 of back portion 28, right zipper 34 not having a catch mechanism;

the right zipper 34 having a right zipper pull tab 38 which includes a friction enhancing material;

right side 24 of front portion 22 having a top area 44, and right side 30 of back portion 28 having a top area 46;

a right connector for selectively connecting top area 44 of right side 24 of front portion 22 to top area 46 of right side 30 of back portion 28;

a left zipper 40 selectively connecting left side 26 of front portion 22 to left side 32 of back portion 28, left zipper 40 not having a catch mechanism;

the left zipper 40 having a left zipper pull tab 45 that includes a friction enhancing material;

left side 26 of front portion 22 having a top area 50, and left side 32 of back portion 28 having a top area 52; and, a left connector for selectively connecting top area 50 of left side 26 of front portion 22 to top area 52 of left side 32 of back portion 28;

(b) the wearer placing right zipper pull tab 38 in an upstanding position and then engaging the right connector; and, (c) the wearer placing left zipper pull tab 45 in an upstanding position and then engaging the left connector.

The preferred embodiments of the invention described herein are exemplary and numerous modifications, variations, and rearrangements can be readily envisioned to achieve an equivalent result, all of which are intended to be embraced within the scope of the appended claims.

I claim:

1. Breakaway sport pants, comprising:

a front portion having a right side and an opposite left side;

a back portion having a right side and an opposite left side;

a right zipper selectively connecting said right side of said front portion to said right side of said back portion, said right zipper having a right zipper slide and a right zipper pull tab, said right zipper not having a catch mechanism for preventing said right zipper slide from unzipping unless said right zipper pull tab is pulled; and, a left zipper selectively connecting said left side of said front portion to said left side of said back portion, said left zipper having a left zipper slide and a left zipper pull tab, said left zipper not having a catch mechanism for preventing said left zipper slide from unzipping unless said left zipper pull tab is pulled;

said right side of said front portion having a top area, and said right side of said back portion having a top area;

a right connector for selectively connecting said top area of said right side of said front portion and said top area of said right side of said back portion;

said left side of said front portion having a top area, and said left side of said back portion having a top area;

a left connector for selectively connecting said top area of said left side of said front portion and said top area of said left side of said back portion;

said right connector including a right flap that is permanently attached to one of said top area of said right side of said front portion and said top area of said right side of said back portion;

said right flap being selectively connectable by connection means to the other of said top area of said right side of said front portion and said top area of said right side of said back portion;

said left connector including a left flap that is permanently attached to one of said top area of said left side of said front portion and said top area of said left side of said back portion;

said left flap being selectively connectable by connection means to the other of said top area of said left side of said front portion and said top area of said left side of said back portion;

said right zipper pull tab including a friction enhancing material which prevents said right zipper pull tab from going down past said right flap thereby preventing said right zipper from inadvertently unzipping;

said left zipper pull tab including a friction enhancing material which prevents said left zipper pull tab from going down past said left flap thereby preventing said left zipper from inadvertently unzipping.

2. The breakaway sport pants according to claim 1, further including:

said top area of said right side of said front portion having an upper edge;

said top area of said right side of said back portion having an upper edge;

said right flap having an upper edge;

said right zipper pull tab having a bottom when in an upstanding position that abuts said upper edge of said right flap, said upper edge of said top area of said right side of said front portion, and said upper edge of said top area of said right side of said back portion thereby preventing said right zipper from inadvertently unzipping;

said top area of said left side of said front portion having an upper edge;

said top area of said left side of said back portion having an upper edge;

said left flap having an upper edge; and, said left zipper pull tab having a bottom when in an upstanding position that abuts said upper edge of said left flap, said upper edge of said top area of said left side of said front portion, and said upper edge of said top area of said left side of said back portion thereby preventing said left zipper from inadvertently unzipping.

3. A method for a wearer to put on breakaway sport pants, comprising:

(a) providing breakaway sport pants, including:

a front portion having a right side and an opposite left side;

a back portion having a right side and an opposite left side;

a right zipper selectively connecting said right side of said front portion to said right side of said back portion, said right zipper not having a catch mechanism;

said right zipper having a right zipper pull tab that includes a friction enhancing material and a bottom when in an upstanding position;

said right side of said front portion having a top area having a top edge, and said right side of said back portion having a top area having a top edge;

a right flap having a top edge for selectively connecting said top area of said right side of said front portion and said top area of said right side of said back portion;

a left zipper selectively connecting said left side of said front portion to said left side of said back portion, said left zipper not having a catch mechanism;

said left zipper having a left zipper pull tab that includes a friction enhancing material and a bottom when in an upstanding position;

said left side of said front portion having a top area having a top edge, and said left side of said back portion having a top area having a top edge; and, a left flap having a top edge for selectively connecting said top area of said left side of said front portion and said top area of said left side of said back portion;

(b) the wearer placing said right zipper pull tab in an upstanding position and then engaging said right flap, wherein said bottom of said right zipper pull tab abuts said top edge of said right flap, said top edge of said top area of said right side front portion, and said top edge of said top area of said right side of said back portion; and said friction enhancing material of said right zipper pull tab prevent said right zipper pull tab from going down past said right flap thereby preventing said right zipper from inadvertently unzipping; and, (c) the wearer placing said left zipper pull tab in an upstanding position and then engaging said left flap, wherein said bottom of said left zipper pull tab abuts said top edge of said left flap, said top edge of said top area of said left side front portion, and said top edge of said top area of said left side of said back portion; and said friction enhancing material of said left zipper pull tab prevent said left zipper pull tab from going down past said left flap thereby preventing said left zipper from inadvertently unzipping.

4. The method of claim 3, including a method for a wearer to quickly remove said breakaway sport pants, further including:

after step (c), the wearer disengaging said right and left flaps and pulling said front portion apart from said back portion without pulling said right zipper pull tab or said left zipper pull tab.

* * * * *